US006244202B1

(12) United States Patent
Tsuta

(10) Patent No.: US 6,244,202 B1
(45) Date of Patent: Jun. 12, 2001

(54) NEEDLE PLATE FOR THE SEWING MACHINE

(76) Inventor: Shigeharu Tsuta, 2-5-27, Nagata, Jooto-ku, Osaka (JP)

( * ) Notice: Subject to any disclaimer, the term of this patent is extended or adjusted under 35 U.S.C. 154(b) by 0 days.

(21) Appl. No.: 09/592,973

(22) Filed: Jun. 12, 2000

(30) Foreign Application Priority Data

Apr. 20, 2000 (JP) ..... 12-119409

(51) Int. Cl.[7] ..... D05B 73/12; D05B 35/00
(52) U.S. Cl. ..... 112/260; 112/153
(58) Field of Search ..... 112/260, 136, 112/147, 153, 139, 151

(56) References Cited

U.S. PATENT DOCUMENTS 1,526,933 * 2/1925 Rhyon ..... 112/260 X
2,977,911 * 4/1961 Moore et al. ..... 112/260
3,020,864 * 2/1962 Katz ..... 112/151 X
3,247,819 * 4/1966 Forca ..... 112/260
4,150,633 * 4/1979 Adams ..... 112/260
4,423,690 * 1/1984 Willenbacher et al. ..... 112/153 X
4,532,874 * 8/1985 Eguchi et al. ..... 112/153 X
5,497,721 * 3/1996 Sulser et al. ..... 112/153

* cited by examiner

*Primary Examiner*—Ismael Izaguirre
(74) *Attorney, Agent, or Firm*—Moonray Kojima

(57) ABSTRACT

The needle plate for the sewing machine supporting the material to be sewn (the fabric) which is pressed by the pressing piece forming the sewing machine, wherein the fabric is sent into the interfacing space between the needle plate and the pressing piece and the support of the receiving plate is elastically turned down, keeping the fabric at intervals allowing for the sending and thus preventing the puckering on the fabric. The fabric guide set on the needle plate for the center sewing is provided on the needle plate where the needle falls and carries out the sewing by regulating the fabric by a determined width of the sewing. The three-fold guide installed on the needle plate for the three-fold sewing is provided on the location where the needle falls, and carries out the sewing by winding the fabric around to make it three-fold.

13 Claims, 13 Drawing Sheets

NEEDLE PLATE FOR THE SEWING MACHINE

BACKGROUND OF THE INVENTION

1. Field of the Invention

The present invention relates to the needle plate for the sewing machine, which supports the materials to be sewn such as textile fabrics, leather and resin sheets in a stable condition, appropriate for the use of a sewing machine.

2. Description of the Prior Art

The conventional way of sewing the above mentioned fabric is by moving forward the sending tooth 62 in order to sew the fabric A provided between the needle plate 60 and the pressing piece 61 forming the sewing machine (The figure is not provided.) as shown in the FIG. 13, for example so that the needle of the sewing machine is moved up and down to sew the fabric. When the pressing piece 61 is pressed against the needle plate 60 to sew the fabric, contact resistance given to the fabric A is so large that it is easy to cause puckering to the fabric A like ruffling, tucking and crumpling.

Therefore the pressing piece 61 is to be once raised to send the fabric A to the position B on the needle plate 60, where the needle is to be fallen. One of the problems involved is that operation efficiency gets worse when the short fabric A is to be sewn consecutively as the pressing piece 61 involves a lot of troubles in the step and operation of moving up and down.

On the other hand, the fabric A which is provided on the position B on the needle plate 60 where the needle is fallen, will be pressed by the pressing piece 61 so that it is impossible to amend the puckering which has occurred before the fabric is provided. Another problem is that when the pressing piece 61 is exchanged or there is a change in the way of sewing, by putting an attachment (The figure is not provided.) for example, a lot of tasks and time are involved, which is necessary for setting the pressure adequate for preventing the puckering or adjusting the position.

SUMMARY OF THE INVENTION

The main purpose of this invention is to provide for a support of the material to be sewn to change its position to permit the sending of the material to be sewn when the material to be sewn is to be sent between the needle plate and the pressing piece, so that it is possible to save tasks and operations like moving up and down the pressing piece every time the material to be sewn is sent forward, saving also the time needed to carry out the moving up and down of the pressing piece. As it is possible to sew the subsequent material to be sewn while just pressing the pressing piece against the needle plate, consecutive operations of sewing the material to be sewn are possible, thus providing for a higher efficiency of the sewing operations.

The support of the material to be sewn bends roughly in function of the thickness of the material to be sewn so that contact resistance given to the material to be sewn is small with less possibilities of puckering, thus providing for a smooth sewing of the material to be sewn.

Another object of the present invention is to support in suspense the material to be sewn on and above the support of the material to be sewn so that a reasonable amount of the pressure will be given against the material to be sewn, thus avoiding errors and omission in sewing and providing for a smooth sewing.

Another object of the present invention is to provide a material to be sewn on the needle plate where the needle falls, regulating it according to the determined width of the sewing with the guide of the material to be sewn so that it is possible to prevent the change in a width of the sewing, allowing for an exact and smooth operation of the sewing.

Another object of the present invention is to provide for a material to be sewn on the needle plate where the needle is to fall by winding around the said material to be sewn with the device to wind around the material to be sewn so that it is possible to prevent the change in a width of the winding, thus allowing for an exact and easy operation of sewing while keeping the material to be sewn wound up in a desired condition.

Another object of the present invention is to move the guide of the material to be sewn and the winding device of the material to be sewn roughly parallel with the sending part of the needle plate, thus allowing for a change in the width and the location of the sewing and making it possible to sew into a desired condition in a stable manner.

Furthermore, another object of the present invention will be easily clarified according to the below mentioned examples.

DESCRIPTION OF THE PREFERRED EMBODIMENT

One of the examples according to the present invention is described below using the drawings.

Figure 1:
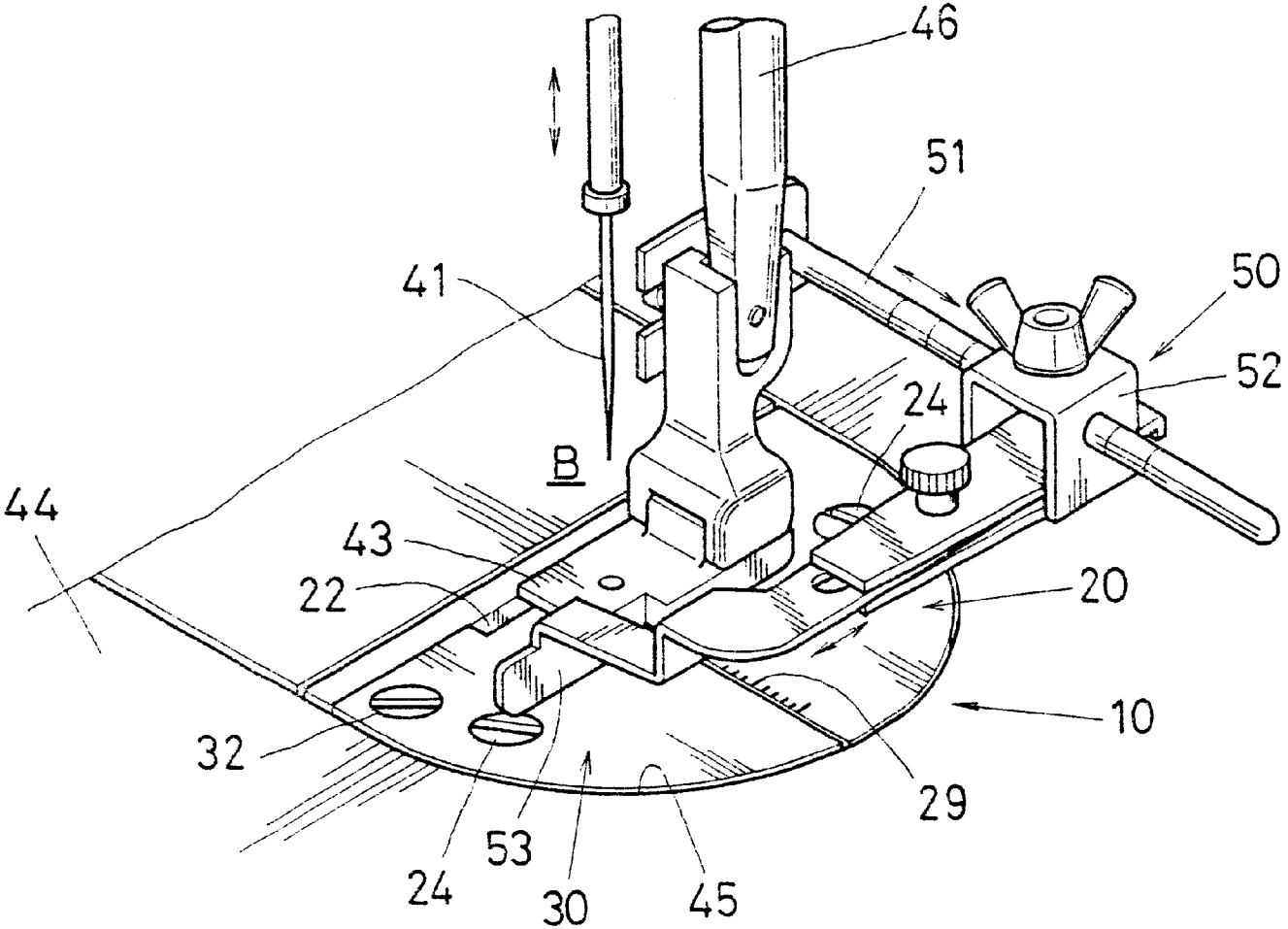
FIG. 1 Perspective view of the setting condition of the needle plate for the sewing machine.
Figure 2:
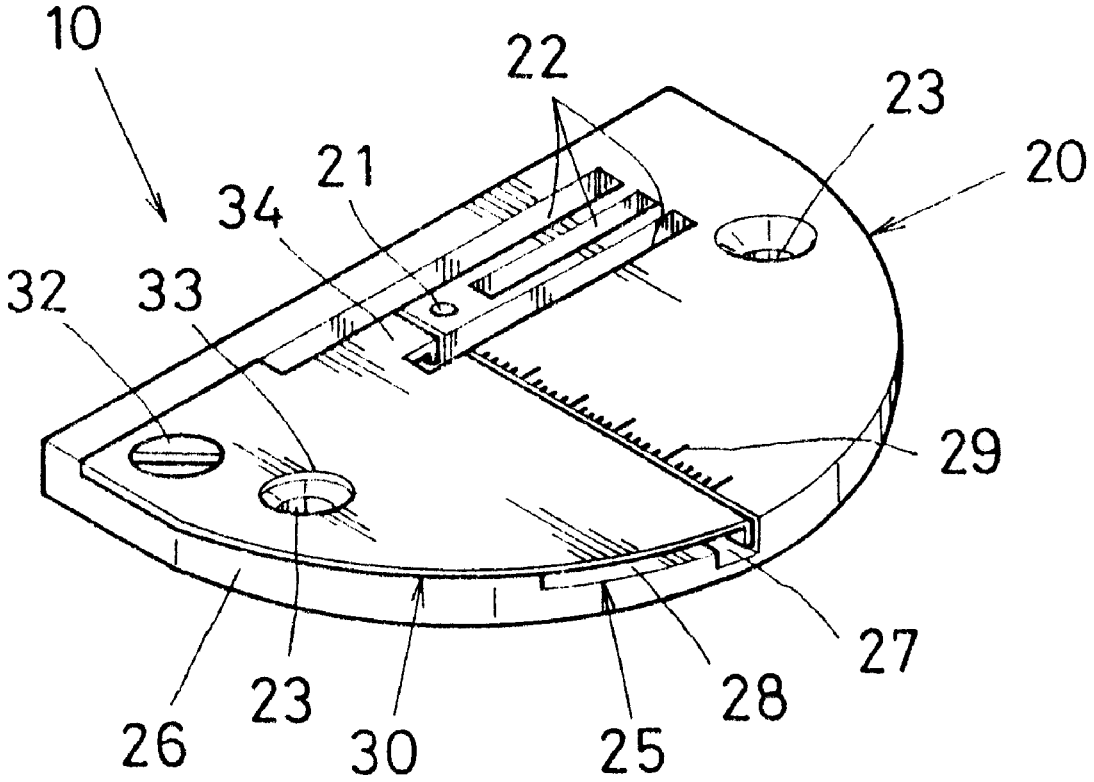
FIG. 2 Perspective view of the needle plate according to the example 1, which is used for additional sewing from above.
Figure 3:
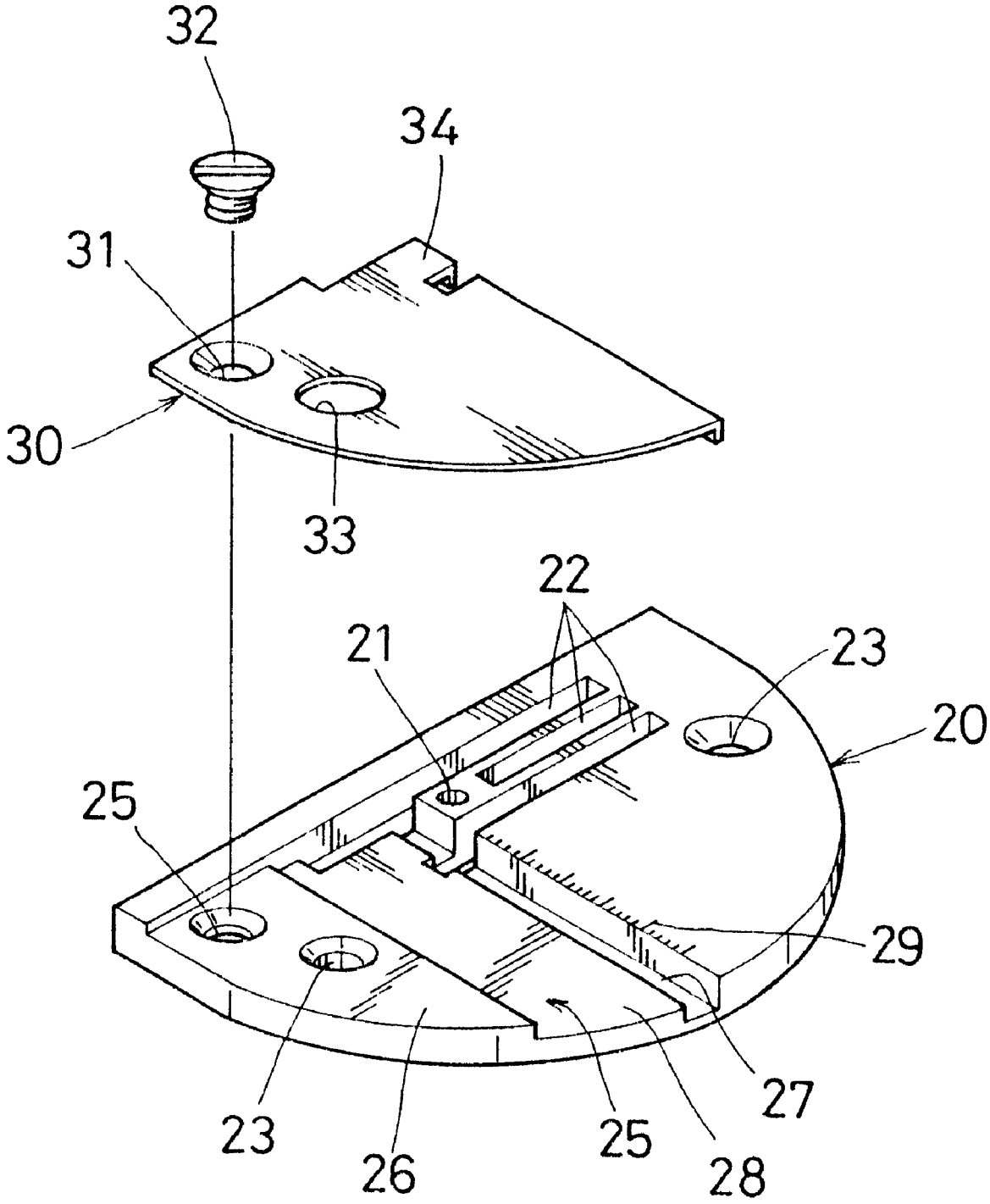
FIG. 3 Perspective view of the needle plate being spread.

The FIG. 1 shows the needle plate for the sewing machine according to the example 1, which is used to sew the fabric A made of textiles, which is one example of the material to be sewn by the sewing machine (The figure is not shown.), which needle plate is constructed with the thick board body 20 formed by aluminum, amalgam and stainless, or simple material or complex material made of materials like synthetic resins and the thin receiving plate 30 having elastic and warping characteristics like a plate spring.

The plate body 20 and the receiving plate 30 may have the sending surface covered and formed by the material like fluorine resin (The commercial name is Teflon.) of which contact resistance is small.

The above mentioned plate body has a roughly half-round shape in the plan view according to the FIGS. from 2 to 5 forming the needle hole 21 on the location B provided on the plate body 20 where the needle falls, the needle hole 21 allowing for the needle of the sewing machine 41 to pass through it and behind and on the side of the same needle hole 21 is provided the long hole 22 which allows for the sending tooth 42 to come out and retract, which long hole 22 is aligned and roughly parallel with the sending direction.

The plate body 20 is inserted into the receiving part of the needle plate 45 formed on the plate of the sewing machine 44 so that the screw 24 is screwed into the screw hole (The figure is not provided.) of the receiving part of the needle plate 45 through the setting hole 23 formed on the front and rear edges of the plate body 20 and the screw 24 is to be fixed in a manner which allows for the setting and removing.

On the sending surface of the location B side where the needle falls, there is provided the scale 29 for the width of the sewing, which scale is formed roughly diagonally with the sending direction in a determined distance from it.

On the other hand, before the location B of the plate body 20 where the needle falls, on the level lower than the sending surface of the plate body 20 there is formed the setting part 25 which is concave and roughly half as large as the plate body 20, into which the receiving plate 30 is inserted and fixed.

On the front edge of the setting part 25 and on the lower level only by the thickness of the receiving plate 30, there is formed the fixing part 26, which fixes the front edge of the receiving plate 30.

Just before the location B of the plate body 20 where the needle falls, the support 34 of the receiving plate 30 faces and is roughly right crossing the concave conduit 27 in the sending direction, the same conduit having the depth and width eventually warped according to the said support 34. Furthermore, between the fixing part 26 and the conduit 27 and on the level lower than the fixing part 26 there is formed a step 28 on the level higher than the conduit 27.

The above mentioned receiving plate 30 has the size and shape roughly corresponding to the setting part 25 in the plan view and when inserted in to the setting part 25, the receiving plate 30 connects the setting hole 31 formed on the front edge of the receiving plate 30, with the screw hole 25 formed on the fixing part 26 of the plate body 20.

Furthermore, after connecting the press connecting hole 33 formed on the vicinity of the setting hole 31 with the setting hole 23 formed in the vicinity of the screw hole 25, the screw 32 is screwed into the screw bole 25 through the setting hole 31 to fix the receiving plate 30 in a manner that allows for putting and removing. The setting hole 31 is formed in the form of a taper wherein the diameters become gradually smaller as they come from the external periphery to the inner periphery.

The sending rear edge of the receiving plate 30 facing the location B of the plate body 20 where the needle falls, is cut out into a form which allows for the sending tooth 42 to come out and retract and at the same time, on the rear edge facing the location B where the needle falls, there is formed the support 34 supporting the fabric A, in the form that allows for bending, whereas the whole length of the rear edge of the receiving plate 30 including the support 34 is bent downward facing the conduit 27 (roughly in the form of the letter L when viewed from the side).

The support 34 is bent downward in terms of the sending surface of the plate body 20, roughly in function of the thickness of the fabric A inserted into the interfacing space between the pressing piece 43 which is fixed on the down edge of the pressing bar 46 forming the sewing machine (The drawing is not provided herein.) and the plate body 20 which is fixed in the inserting part of the needle plate 45 of the plate of the sewing machine 44.

Furthermore, when the fabric A is taken out from the above mentioned interfacing space, the support 34 has the necessary elasticity to recover the height roughly corresponding to the level of the sending surface of the plate body 20. Also, the elasticity of the receiving plate 30 may be variably set according to the thickness or stiffness, for example, of the fabric A.

When the above mentioned needle plate for the sewing machine 10 is used to perform the sewing operations like the additional sewing from top or the straight sewing, the fabric A may be guided to sew by the determined width with the stitch guide 50 installed on the below edge of the pressing bar 46 as shown in the FIG. 1 and FIG. 4.

The stitch guide 50 fixes the base end part of the supporting axle roughly on a level with the below end part of the pressing bar 46 and adjusts moving the supporting material 52 installed on the supporting axle 51 in the right and left direction roughly right crossing the sending direction and also adjusts moving the guiding plate 53 installed on the below part of the supporting material 52 in the front and back direction roughly parallel with the sending direction and after setting the guiding plate 53 in a determined interval with the location B where the needle falls, the stitch guide 50 provides the fabric A, guiding it to the location B where the needle falls, regulating the same fabric to the determined width of the sewing with the guiding plate 53. It is also possible to carry out the sewing operation of the fabric A without using the above mentioned stitch guide 50.

The additional sewing from top (or straight sewing) using the needle plate for the sewing machine which is constructed in the above mentioned manner is explained below.

Figure 4:
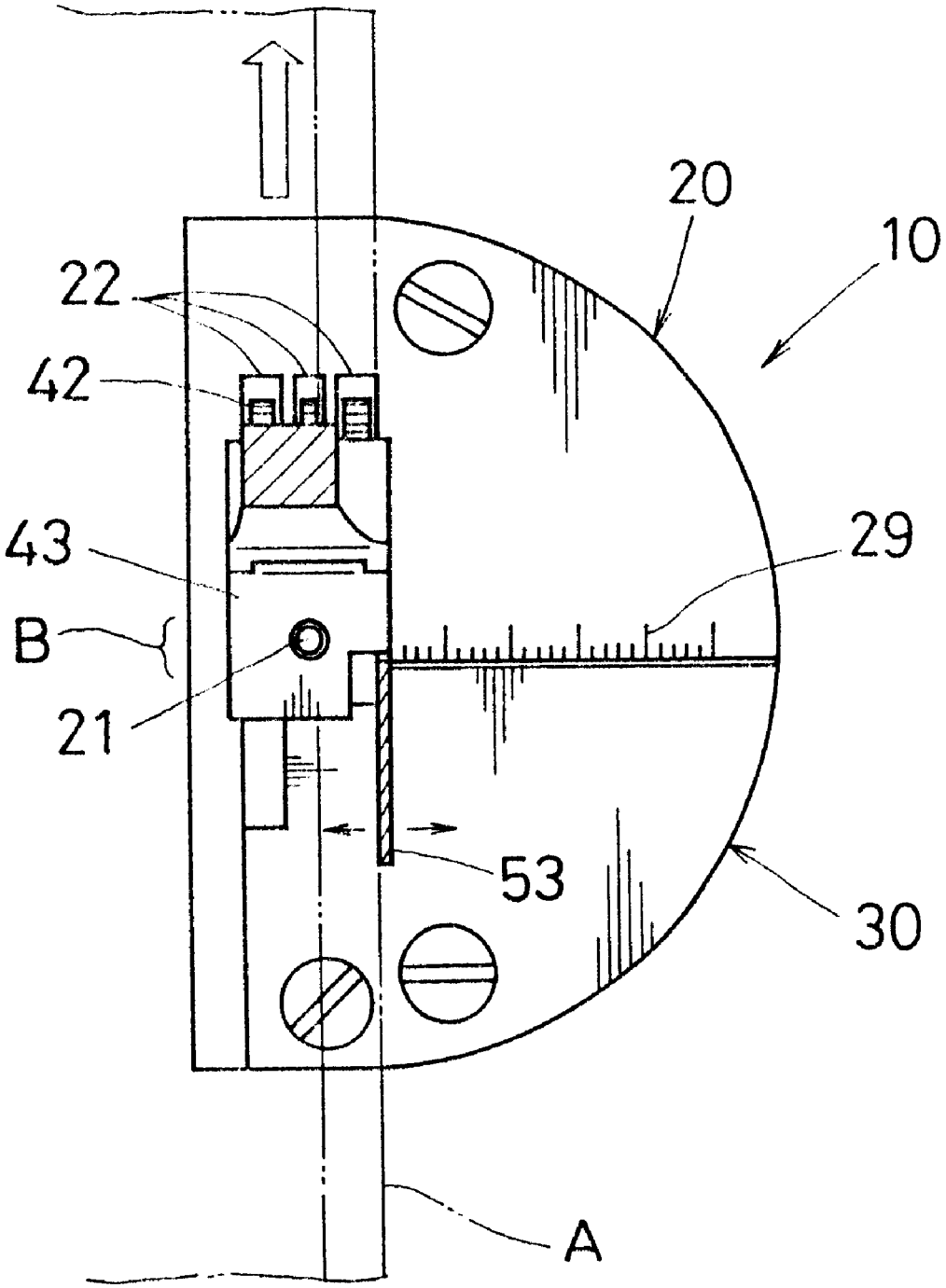
FIG. 4 Plan view of the fabric being sewn.
Figure 5:
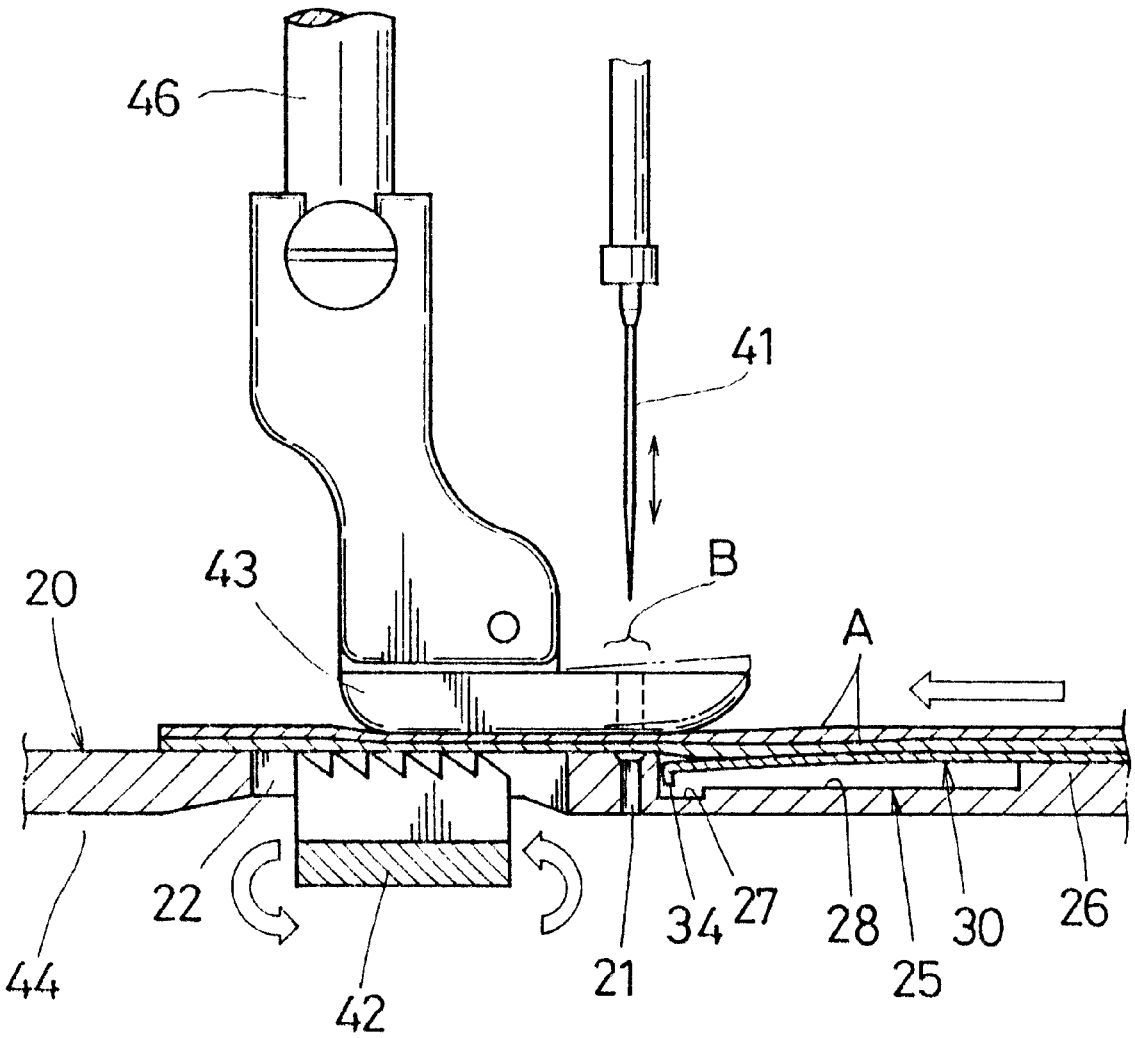
FIG. 5 Vertical side section of the fabric being sewn and the support warped.

As is shown in the FIG. 4 and the FIG. 5 the fabric A yet to be sewn is provided on the location B on the needle plate 10 where the needle falls, along the guiding plate 53 on the stitch guide 50, the support 34 of the receiving plate 30 is elastically warped downward by the fabric A itself so that the receiving plate 30 and the pressing piece 43 is so parted from each other as to permit the fabric A to be sent inside.

As the needle of the sewing machine 41 is also moved up and down and the sending tooth 42 is sending the fabric A forward in the sending direction to sew it, every time the fabric A is sent, it becomes needless to move the pressing piece up and down, thus saving the time which has been taken to operate up and down.

As the pressing piece 43 can sew the next coming fabric A while pressing the needle plate 10, it is possible to sew the fabric A consecutively, thus raising the efficiency of the sewing operation.

Furthermore, the support 34 is warped roughly in function of the thickness of the fabric A and contact resistance given to the fabric A is small, allowing for a smooth sewing of the fabric A without causing the puckering such as ruffling, tucking and crumpling.

Figure 6:
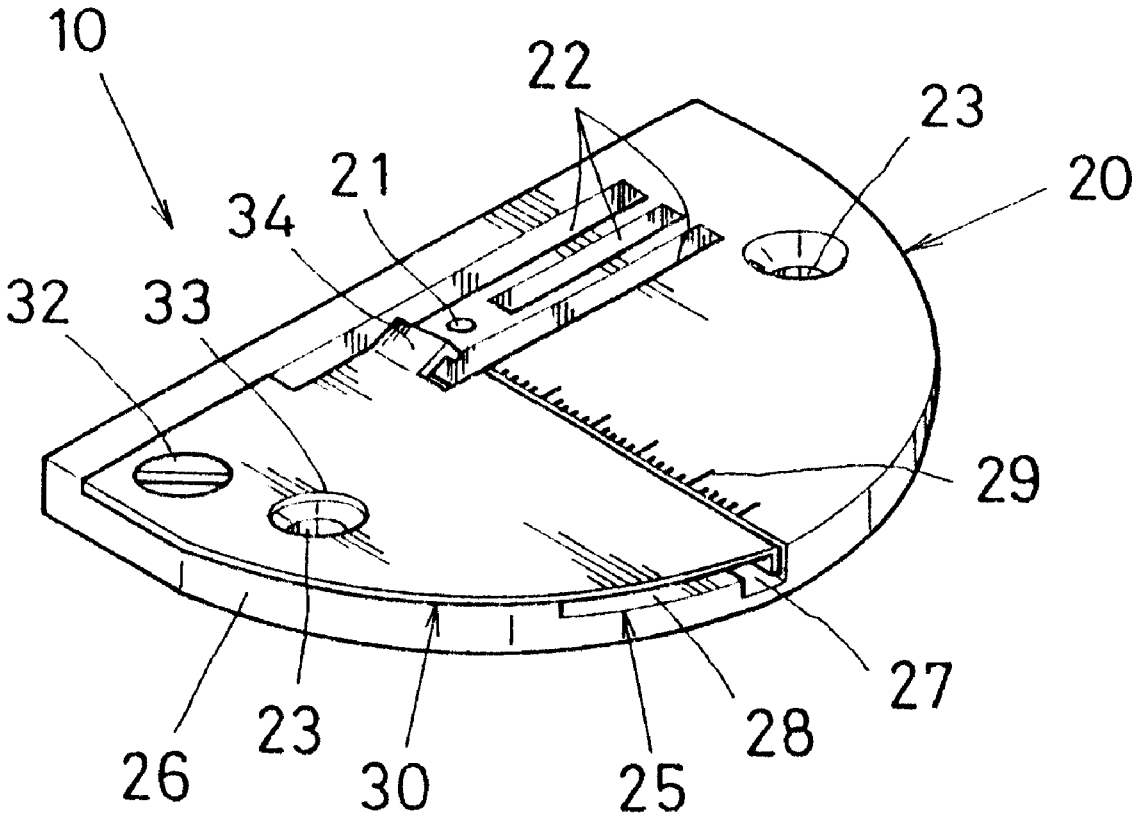
FIG. 6 Perspective view showing another example of the support of the receiving plate being inclined upward accordingly.

The FIG. 6 shows another example of the receiving plate 30, wherein the support 34 of the receiving plate 30 is raised, protruding upward from the sending surface of the plate body 20, inclining or bending gradually upwards as it goes in the sending direction.

In this case, the fabric A is supported in suspense over the support 34 and by force of the support 34 which is warped and inclined at the same time, the fabric A is pressed in an appropriate manner, allowing for a smooth sewing without causing incorrectness or omission in the sewing and it is possible to have an effect roughly parallel with the above mentioned examples. The fabric A may be guided only by the inclination of the support 34.

Figure 7:
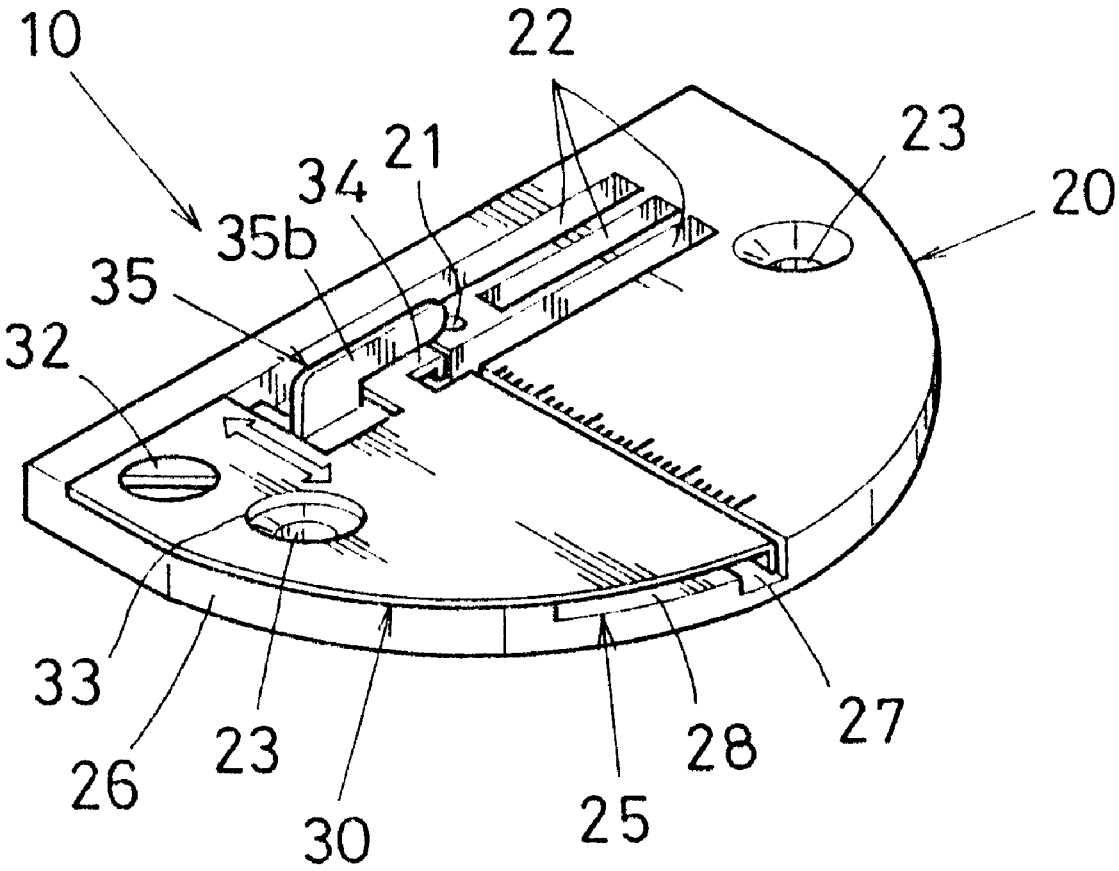
FIG. 7 Perspective view of the needle plate according to the example 2, which is used for the center sewing.
Figure 8:
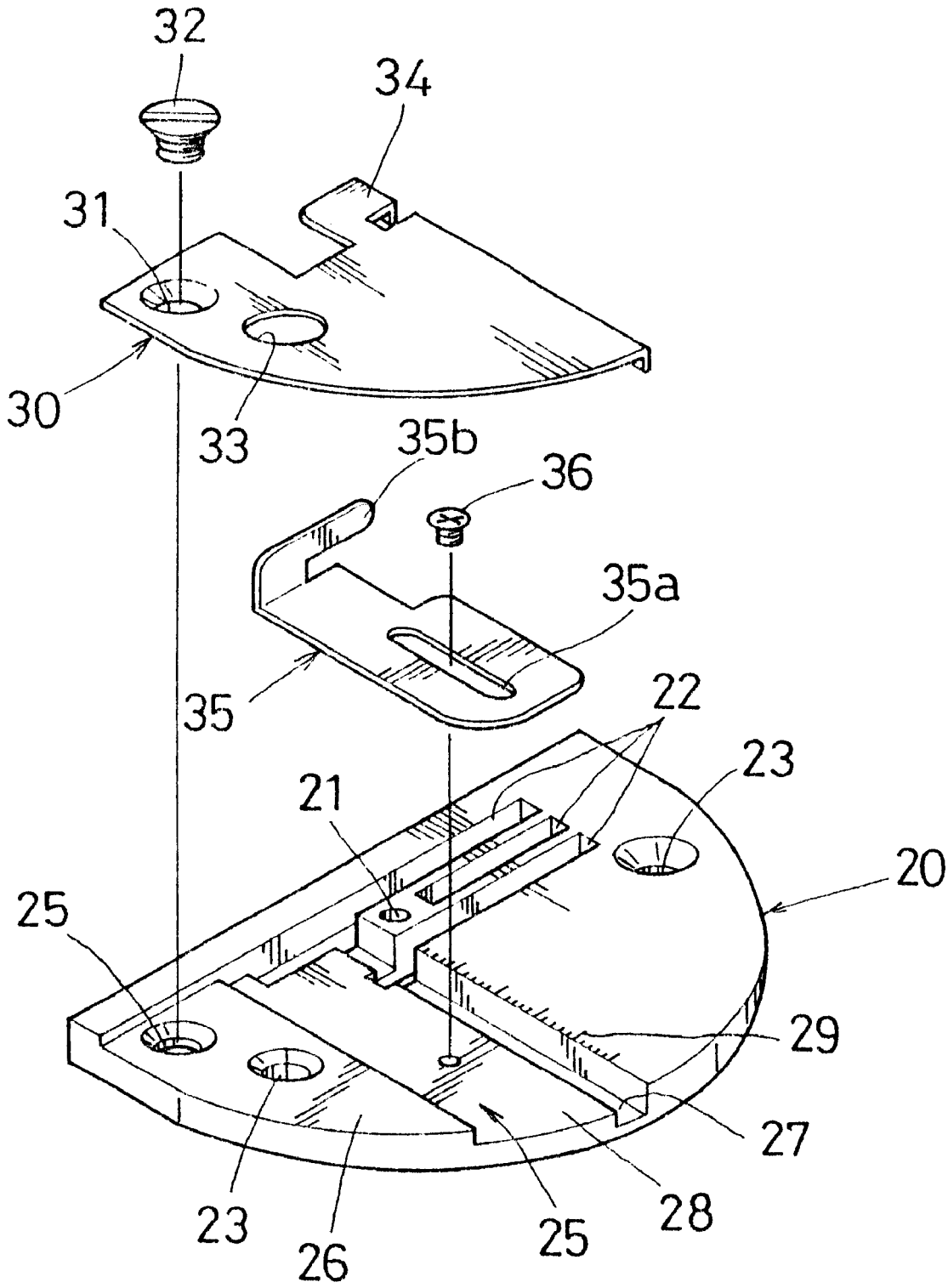
FIG. 8 Perspective view of the needle plate being spread.

The FIG. 7 and the FIG. 8 show the needle plate for the sewing machine 10 according to the example 2, which is used for the center sewing, wherein the fabric A is guided roughly straight by the fabric guide 35 installed right before the location B of the needle plate 10 where the needle falls.

One end of the fabric guide 35 is inserted into the interfacing space between the plate body 20 and the receiving plate 30 and through the long hole 35*a* formed on the one end of the fabric guide 35, the screw 36 is screwed into the screw hole 28*a* formed on the middle step 28.

On the other hand, the other end of the fabric guide 35 is protruded upward from the part which has been cut out on the sending side edge of the receiving plate 30 and on the protruding side edge, the fabric guide 35 is bent in the rising direction roughly vertical viewed from the sending direction, thus forming the guiding part 35*b* roughly parallel with the sending direction.

Figure 9:
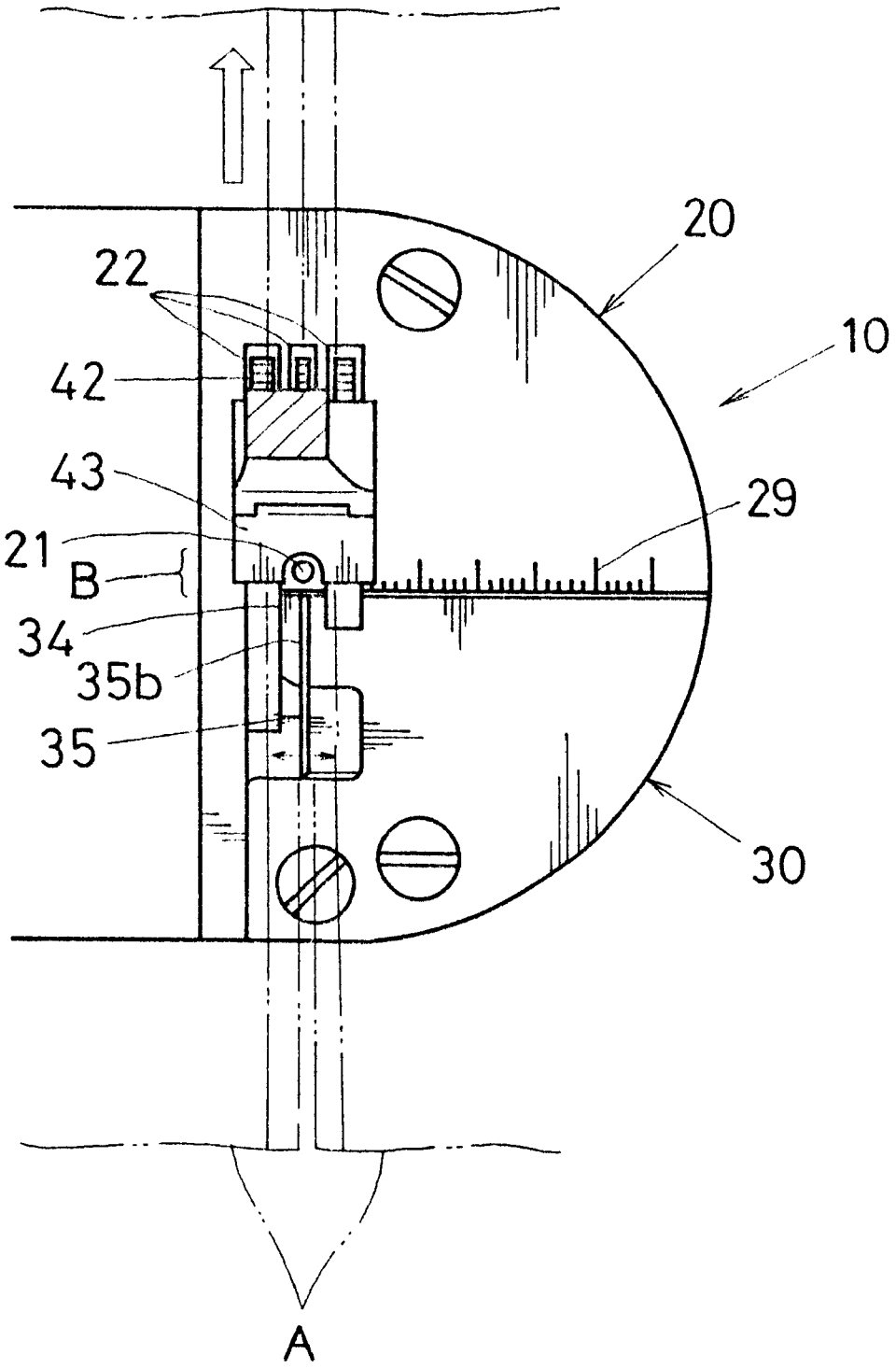
FIG. 9 Plan view of the fabric being sewn.

In the center sewing, as is shown in the FIG. 9, after the guiding part 35*b* is adjusted and slid into a location facing the location B where the needle falls, the fabric A which is virtually lined in the figure is provided roughly vertical against the location B where the needle falls, regulating the fabric by the determined width of the sewing along the guiding part 35*b*, thus preventing a change in the width of the sewing and allowing for an exact and easy operation of sewing by a determined width of the sewing.

Furthermore, by force of the support 34 and the guiding part 35*b* being operated, the consecutive sewing is to be done regulating the fabric by a determined width of the sewing, thus allowing for a smooth operation of sewing by a determined length, providing for parallel effects with the needle plate 10 according to the example 1.

Figure 10:
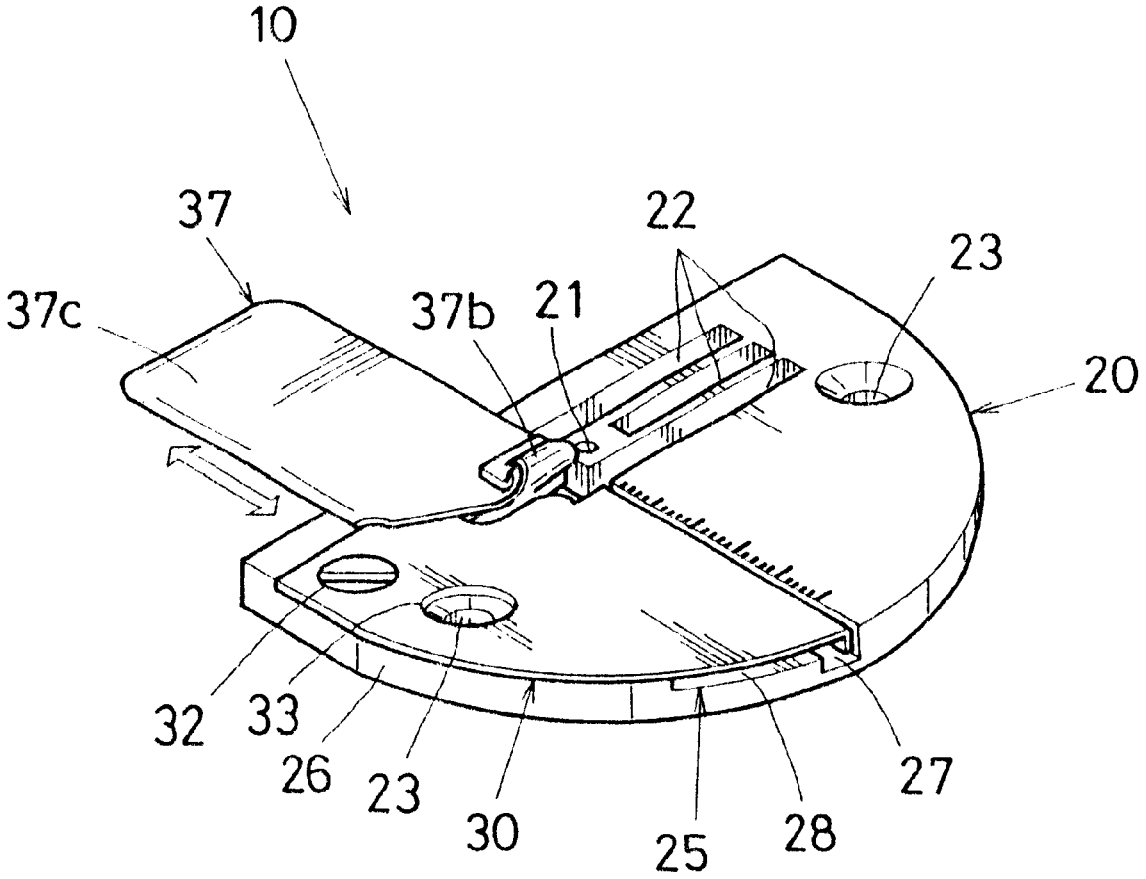
FIG. 10 Perspective view of the needle plate according to the example 3, which is used for the three-fold sewing.
Figure 11:
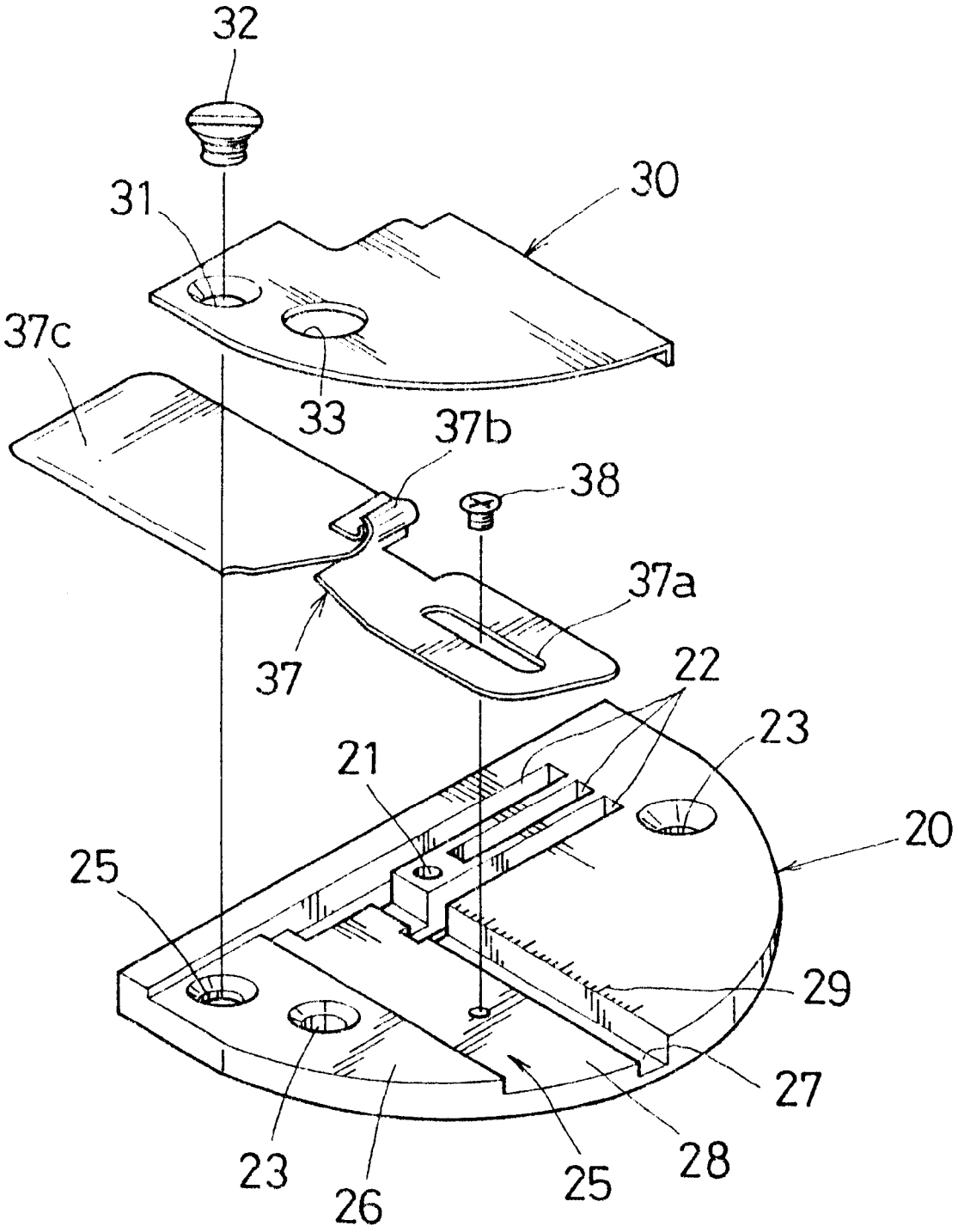
FIG. 11 Perspective view of the needle plate being spread.

The FIG. 10 and the FIG. 11 show the needle plate 10 for the sewing machine according to the example 3, which is used for the three-fold sewing, wherein the fabric A is guided and wound around to be three-fold by the three-fold winding guide 37 installed right before the location B of the needle plate 10 where the needle falls.

One end side of the three fold winding guide 37 is inserted into the interfacing space between the plate body 20 and the receiving plate 30 and through the long hole 37*a* formed on the inserting side, the screw 38 is screwed into the screw hole 28*a* formed on the step part 28.

On the other hand, the other end side of the three-fold guide 37 is protruding upward from the part cut out on the sending side edge of the plate 30 and on the protruding side edge there is formed the winding device 37*b* which seems spiral when viewed from the sending direction and of which diameters become smaller as it goes in the sending direction.

On and close to the side of the winding device 37*b*, the support 37*c* is installed, supporting the fabric A roughly on a level with the sending surface of the plate body 20.

Figure 12:
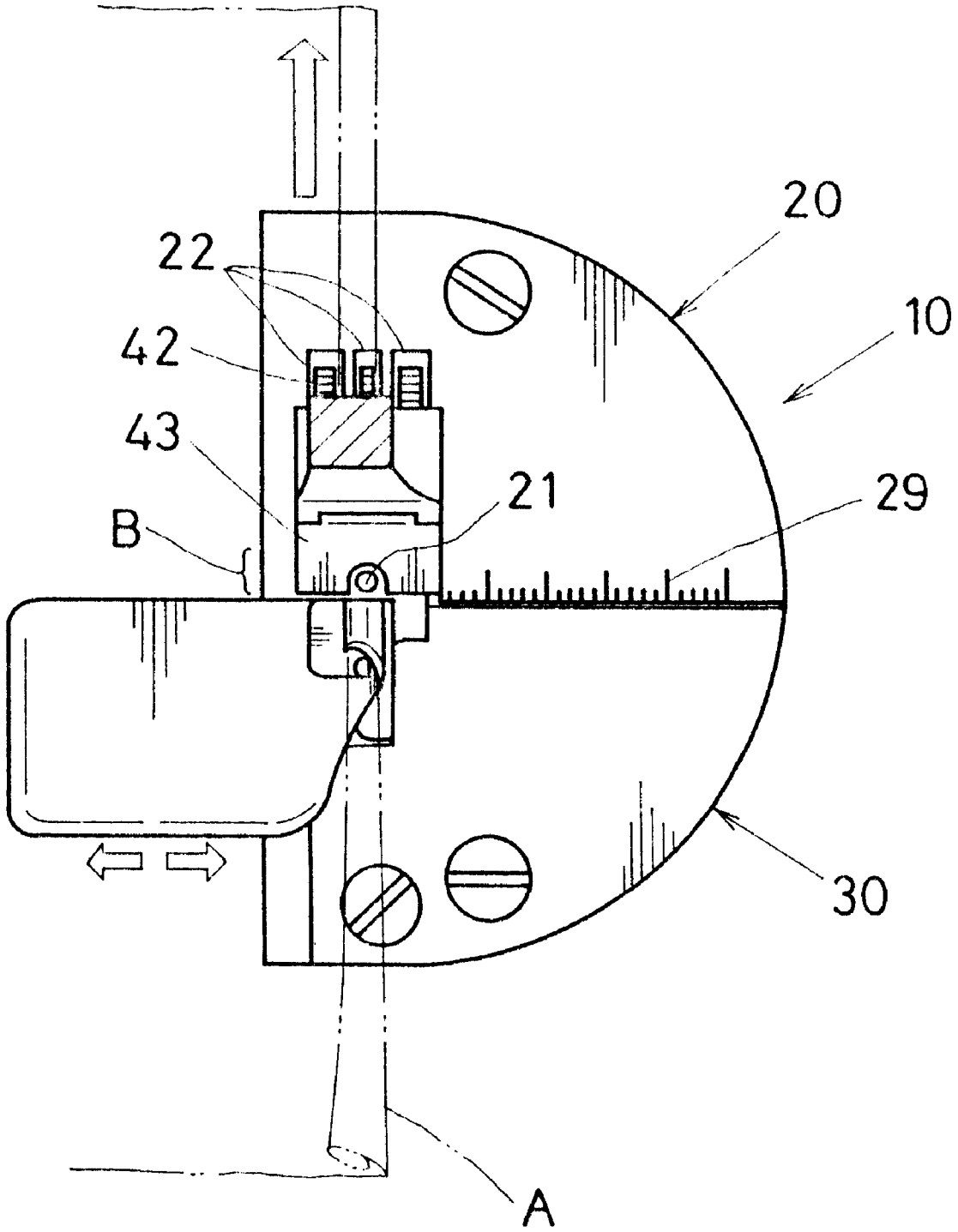
FIG. 12 Plan view of the fabric being sewn.
Figure 13:
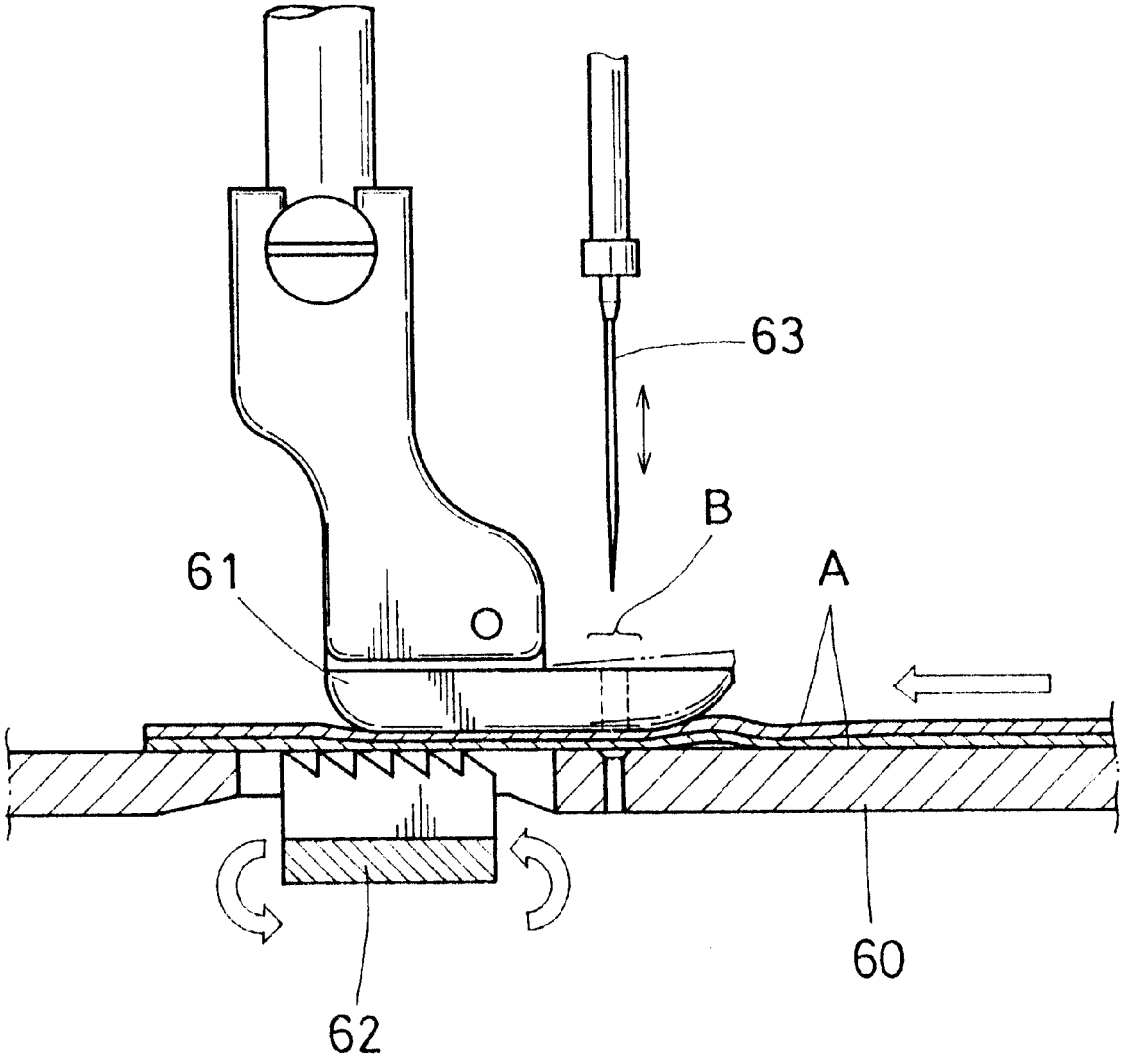
FIG. 13 Vertical side section of the sewing provided by the needle plate and the pressing piece according to the conventional examples.

In the three-fold winding, as is shown in the FIG. 12, the winding part 37*b* is adjusted and slid into a location facing the location B where the needle falls and afterwards, the fabric A in the virtual line in the drawing is pressed by the pressing piece 43 with the winding device 37*b* winding three-fold, it is possible to prevent a change of the width of the winding, thus allowing for an exact and easy operation of the sewing, wherein the fabric is sewn while winding in a desired condition. As the receiving plate 30 is elastically changed, it can have effects roughly parallel with the needle plate 10 according to the example 1.

Furthermore, the above mentioned fabric guide 35 and the three-fold guide 37 may be installed in a way which allows for moving back and forth and prevents swinging right and left and the winding device 37*b* of the three-fold guide 37 may be changed into a winding form such as a two-fold sewing or a four-fold sewing.

In accordance with the construction of the present invention and the above mentioned examples, the material to be sewn of the present invention corresponds to the fabric A of the examples, while the support of the material to be sewn corresponding to the support 34, the guide of the material to be sewn corresponding to the guide 35*b* of the fabric guide 35, the winding part of the material to be sewn corresponding to the winding device 37*b* of the three-fold guide 37. However, it is to be understood that the present invention is not limited by the construction of the above examples.

The needle plate for the sewing machine according to the examples can also be used for the sewing machine to sew the materials to be sewn like resin sheets or leather.

What is claimed is:

1. A sewing machine needle plate device comprising:

a flat body having a bottom surface and a top surface, said top surface supporting a material to be sewn and comprising a setting part of a first surface which is lower than said top surface, and adjacent thereto a conduit having a second surface which is lower than said first surface;

a flexible receiving plate comprising a top surface and a support piece at an end thereof; and means for attaching said receiving plate to said top surface of said flat body so that a top surface of said receiving plate is generally on a same plane as said top surface of said flat body in one position, and so that said receiving plate is bent in another position with said support piece of said receiving plate being fitted into said conduit.

2. The device of claim 1, further comprising guide means disposed above said top surface of said flat body for guiding material to be sewn.

3. The device of claim 1, wherein said support piece comprises a part which extends above said top surface of said flat body.

4. The device of claim 1, further comprising guide means disposed above said top surface of said flat body and attached to said flat body.

5. The device of claim 4, wherein said guide means comprises a first plate disposed between said body and said receiving plate.

6. The device of claim 5, wherein said guide means comprises, a second plate disposed above said top surface and means for connecting said second plate to said first plate.

7. The device of claim 6, wherein said means for connecting comprises a generally circular first piece of said first plate and a generally circular second piece of said second plate, said first piece being movably connected to said second piece.

8. The device of claim 7, wherein said second plate is movable in a plane parallel to said top surface.

9. The device of claim 3, wherein said support piece extends gradually upward from said top surface.

10. The device of claim 2, wherein said guide means is disposed at a position which is before a position whereat a needle is moved downward.

11. The device of claim 1, further comprising winding means for winding back said material roughly against an edge direction.

12. The device of claim 2, wherein said guide means is movable in a direction roughly parallel to said top surface.

13. The device of claim 11, wherein said winding means is disposed in a direction roughly parallel to said top surface.

* * * * *